US008636547B2

(12) United States Patent
Ha et al.

(10) Patent No.: US 8,636,547 B2
(45) Date of Patent: Jan. 28, 2014

(54) CONNECTOR WITH A SECOND COULING UNIT EXTENDING FROM A BOTTOM FACE OF A FIRST COUPLING UNIT

(75) Inventors: Joo Young Ha, Gyunggi-do (KR); Young An Choi, Gyunggi-do (KR); In Taek Song, Gyunggi-do (KR); Hae Jin Jeon, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 13/327,259

(22) Filed: Dec. 15, 2011

(65) Prior Publication Data

US 2013/0052875 A1 Feb. 28, 2013

(30) Foreign Application Priority Data

Aug. 26, 2011 (KR) ..... 10-2011-0085769

(51) Int. Cl.
*H01R 24/00* (2011.01)

(52) U.S. Cl.
USPC ..... 439/626

(58) Field of Classification Search
USPC ..... 439/626, 80, 814, 798
See application file for complete search history.

(56) References Cited

U.S. PATENT DOCUMENTS

| | | | | |
|---|---|---|---|---|
| 3,312,927 | A * | 4/1967 | Garrett | 439/80 |
| 3,665,509 | A * | 5/1972 | Elkins | 439/42 |
| 3,831,133 | A * | 8/1974 | Grundfest | 439/680 |
| 6,939,183 | B2 * | 9/2005 | Ferretti et al. | 439/798 |
| 7,131,844 | B1 * | 11/2006 | Wurr | 439/20 |
| 7,618,299 | B2 * | 11/2009 | Ferretti | 439/814 |
| 8,021,191 | B2 * | 9/2011 | Long | 439/626 |
| 2010/0151736 | A1 * | 6/2010 | Long | 439/626 |
| 2011/0039452 | A1 * | 2/2011 | Cheng | 439/626 |
| 2011/0269345 | A1 * | 11/2011 | He | 439/626 |

FOREIGN PATENT DOCUMENTS

| | | | |
|---|---|---|---|
| DE | 673634 | C | 1/1941 |
| DE | 2323612 | A1 | 11/1974 |
| DE | 102004042671 | A1 | 3/2006 |
| KR | 10-2008-0076616 | A | 8/2008 |
| KR | 10-2011-0056969 | A | 5/2011 |
| KR | 10-2011-0058485 | A | 6/2011 |

OTHER PUBLICATIONS

German Office Action, and English translation thereof, issued in German Patent Application No. 102011117637.7 dated Aug. 10, 2012.

* cited by examiner

*Primary Examiner* — Chandrika Prasad
(74) *Attorney, Agent, or Firm* — McDermott Will & Emery LLP

(57) ABSTRACT

There are provided a connector and a connector module which may commonly use mutually different interface schemes, and an electronic apparatus having the same. The connector includes a body having a fixed volume; and at least one coupling hole formed inwardly in a side of the body, and electrically coupled with a pin from the outside, wherein the coupling hole includes a first coupling unit having a predetermined first depth and electrically coupled with the pin from the outside, and a second coupling unit having a second depth deeper than the first depth and electrically coupled with another pin from the outside.

20 Claims, 7 Drawing Sheets

CONNECTOR WITH A SECOND COULING UNIT EXTENDING FROM A BOTTOM FACE OF A FIRST COUPLING UNIT

CROSS-REFERENCE TO RELATED APPLICATIONS

This application claims the priority of Korean Patent Application No. 10-2011-0085769 filed on Aug. 26, 2011, in the Korean Intellectual Property Office, the disclosure of which is incorporated herein by reference.

BACKGROUND OF THE INVENTION

1. Field of the Invention

The present invention relates to a connector and a connector module, in which different interface schemes may be used in common, and an electronic apparatus having the same.

2. Description of the Related Art

In general, a connector includes a connector housing and a coupling hole, and is widely used in an electric circuit in a washing machine, a refrigerator, an automobile, and the like. When the connector is used in this electrical and electronic equipment, it is inserted into a final product after a plurality of components are individually assembled, thereby greatly simplifying maintenance as well as equipment manufacturing.

In this instance, the connector is coupled with a mating connector to be electrically connected thereto. More specifically, by the coupling of the two connectors, the coupling hole provided in the connector housing and a mating coupling hole provided in a mating connector housing come into contact to be electrically connected. That is, the connector is electrically connected or disconnected with the mating connector by the attachment or detachment of the connector to and from the mating connector.

As types of electrical and electronic equipment are diversified, the connector may be electrically connected with various types of interfaces. In this instance, when the connector is provided for each interface, miniaturization is difficult, due to the increased volume of the electrical and electronic equipment, and manufacturing costs are increased.

SUMMARY OF THE INVENTION

An aspect of the present invention provides a connector and a connector module, in which two coupling units having different depths are formed in a single coupling hole to be commonly used for pins having different interface schemes, and an electronic apparatus having the same.

According to an aspect of the present invention, there is provided a connector, including: a body having a fixed volume; and at least one coupling hole formed inwardly in a side of the body, and electrically coupled with a pin from the outside. Here, the coupling hole includes a first coupling unit having a predetermined first depth and electrically coupled with the pin from the outside, and a second coupling unit having a second depth deeper than the first depth and electrically coupled with another pin from the outside.

The first coupling unit and the second coupling unit of the coupling hole may have a step formed therebetween.

The first coupling unit may have a lateral length and a longitudinal length of a cross section thereof larger than those of a cross section of the second coupling unit.

The coupling hole may include a plurality of coupling holes formed in the side of the body.

According to another aspect of the present invention, there is provided a connector module, including: a first connector including a first body having a fixed volume, and at least one coupling hole formed inwardly in a side of the first body and electrically coupled with a pin from the outside, the coupling hole including a first coupling unit having a predetermined first depth and electrically coupled with the pin from the outside, and a second coupling unit having a second depth deeper than the first depth and electrically coupled with another pin from the outside; and a second connector including a second body having a fixed volume, and a pin formed on a side of the second body and inserted into the coupling hole.

The second connector may include a plurality of pins.

The second connector may include a first pin unit having a first pin electrically coupled with the first coupling unit, or a second pin unit having a second pin electrically coupled with the second coupling unit.

According to another aspect of the present invention, there is provided an electronic apparatus, including: a connector module including a first connector including a first body having a fixed volume, and at least one coupling hole formed inwardly in a side of the first body and electrically coupled with a pin from the outside, the coupling hole including a first coupling unit having a predetermined first depth and electrically coupled with the pin from the outside, and a second coupling unit having a second depth deeper than the first depth and electrically coupled with another pin from the outside, and a second connector including a second body having a fixed volume, and a pin formed on a side of the second body and inserted into the coupling hole; a housing supporting the first connector and having an electronic circuit electrically connected with the coupling hole; and an operation circuit supported by the housing, and connected to the electronic circuit to execute a predetermined operation.

The electronic apparatus may include: a Local Interconnect Network (LIN) interface unit electrically connected with the first coupling unit to perform data communication in an LIN interface scheme; a control unit performing data communication with the LIN interface unit to control memory storage; and a memory electrically connected with the control unit and the second coupling unit to perform data communication in a Serial Peripheral Interface (SPI) scheme.

The operation circuit may be a lens module imaging an object.

The electronic circuit may further include a connection unit electrically connecting the first coupling unit with the LIN interface unit, and electrically connecting the second coupling unit with the memory.

The housing may further include a first circuit board and a second circuit board, the connection unit may be formed in the first circuit board, and the LIN interface unit, the control unit and the memory may be formed in the second circuit board.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Embodiments of the present invention will now be described in detail with reference to the accompanying drawings.

Figure 1A:
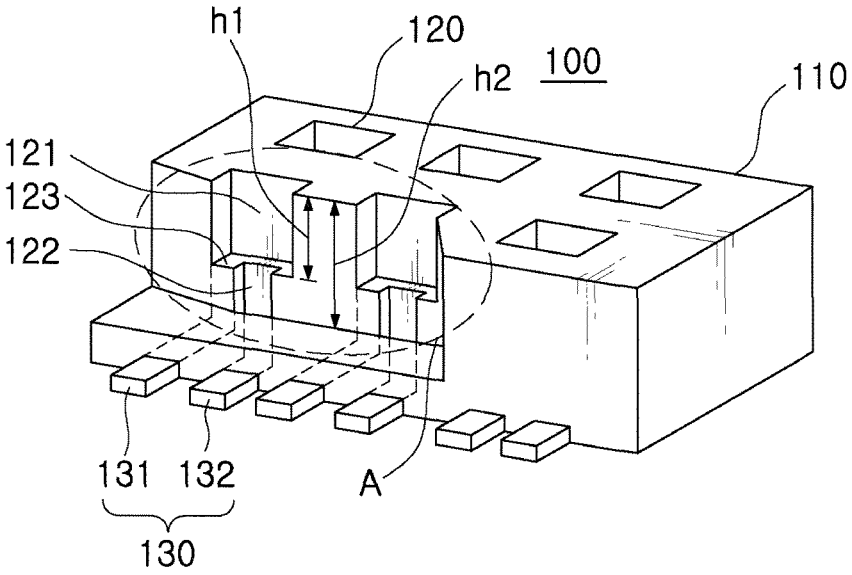
FIGS. 1A and 1B are configuration diagrams of a connector according to an embodiment of the present invention.
Figure 1B:
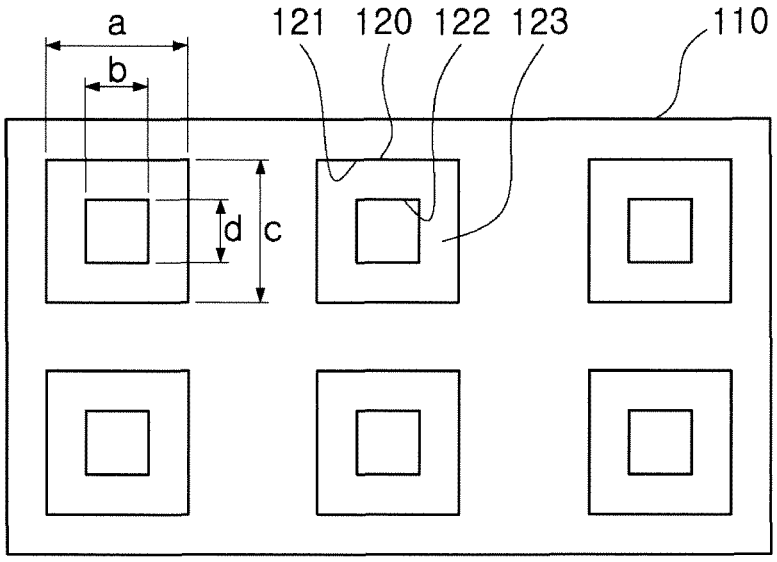

FIGS. 1A and 1B are configuration diagrams of a connector according to an embodiment of the present invention.

FIG. 1A is a perspective view of a connector 100 according to an embodiment of the present invention, and FIG. 1B is a plane view of the connector 100 according to an embodiment of the present invention.

Referring to FIG. 1A, the connector 100 according to an embodiment of the present invention may include a body 110 having a fixed volume, and a coupling hole 120 formed inwardly in a side of the body 110. A terminal unit 130 electrically connected with the coupling hole 120 maybe formed in the other side of the body 110.

A plurality of coupling holes 120 may be provided in the side of the body 110, and a first coupling unit 121 and a second coupling unit 122 may be formed inside each of the plurality of coupling holes 120.

Each of the first coupling unit 121 and the second coupling unit 122 may be coupled with a pin inserted from the outside, to be electrically connected therewith, and a different pin may be coupled with the first coupling unit 121 or the second coupling unit 122.

Referring to reference numeral "A" of FIG. 1A, indicating an inner cross-section part of the connector 100, the first coupling unit 121 and the second coupling unit 122 which are formed in the coupling hole 120 may be formed in the same position and may have different depths. Accordingly, a bottom surface of the first coupling unit 121 may have a first depth h1, and a bottom surface of the second coupling unit 122 may have a second depth h2, deeper than the first depth h1. In addition, so that the first coupling unit 121 and the second coupling unit 122 are electrically connected with different pins, the second coupling unit 122 may be formed in an inner direction of the body 110 from the bottom surface of the first coupling unit 121. Also, a step 123 may be formed between the first coupling unit 121 and the second coupling unit 122. An inner surface of each of the first coupling unit 121 and the second coupling unit 122 may be formed of a conductor so as to be electrically connected with the pin inserted from the outside, and may be connected with corresponding terminal units 131 and 132.

Referring to FIG. 1B, in order to form the step between the first coupling unit 121 and the second coupling unit 122, a longitudinal length (a) and a lateral length (c) of a cross section of the first coupling unit 121 may be larger than a longitudinal length (b) and a lateral length (d) of a cross section of the second coupling unit 122. Accordingly, even in the case that the first coupling unit 121 and the second coupling unit 122 may be formed in the same position, when the pin inserted from the outside is connected with the first coupling unit 121, the pin may not contact the second coupling unit 122; whereas when the pin inserted from the outside is connected with the second coupling unit 122, the pin may not contact the first coupling unit 121.

Figure 2A:
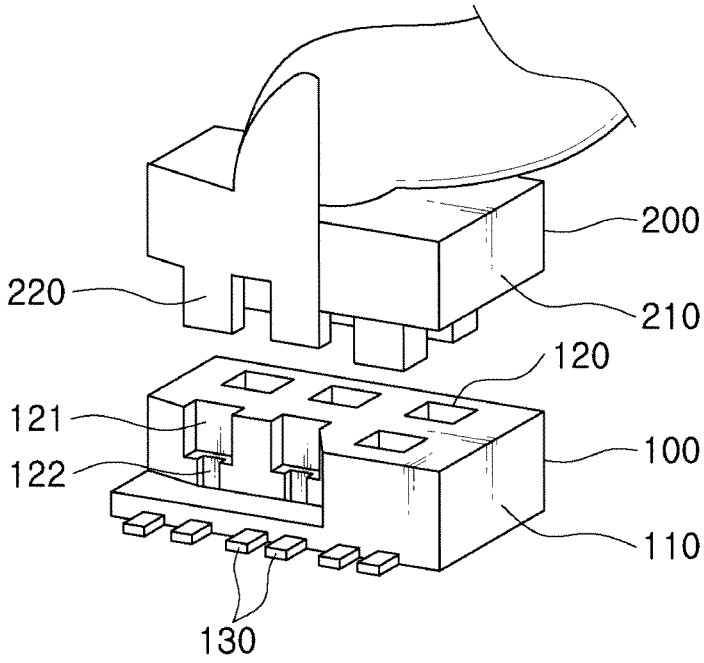
FIGS. 2A and 2B are configuration diagrams of a connector module according to an embodiment of the present invention.
Figure 2B:
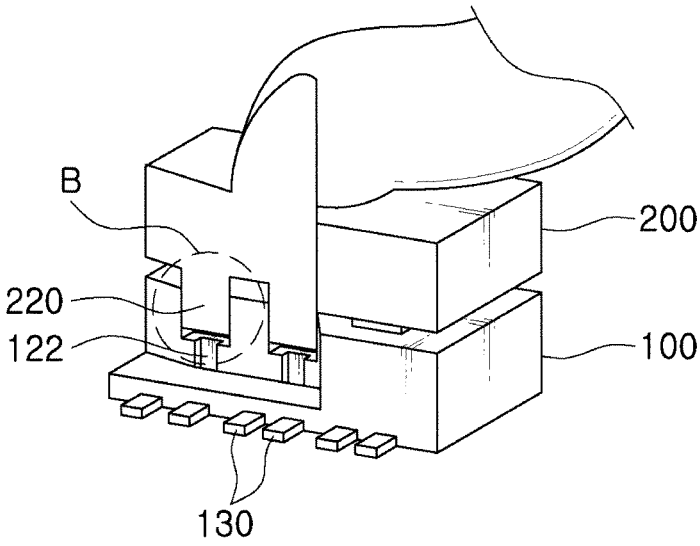

FIGS. 2A and 2B are configuration diagrams of a connector module according to an embodiment of the present invention.

Referring to FIG. 2A, a connector module according to an embodiment of the present invention may include a first connector 100 and a second connector 200.

The first connector 100 may be the same as the connector 100 shown in FIGS. 1A and 1B, and thus, detailed descriptions thereof will be omitted.

The second connector 200 may be electrically coupled with the first connector 100. To enable this, the second connector 200 may include a body 210 having a fixed volume, and a first pin unit 220 provided in the body 210 and electrically coupled with the first coupling unit 121 of the first connector 100. A plurality of first pins of the first pin unit 220 may correspond to the number of the coupling holes 120, and each of the plurality of first pins may be electrically coupled with the first coupling unit 121 as shown in FIG. 2B. Referring to reference numeral "B", when electrically coupled with the first coupling unit 121, the first pin does not contact the second coupling unit 122.

Figure 3A:
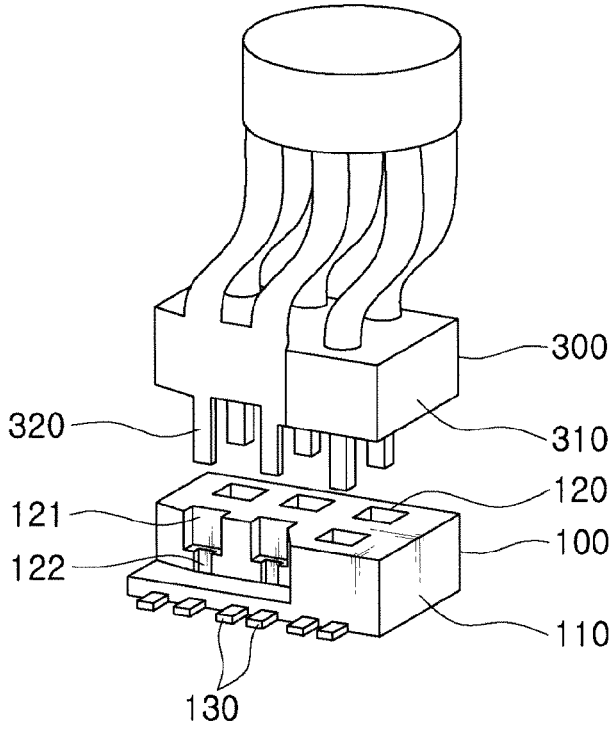
FIGS. 3A and 3B are configuration diagrams of a connector module according to another embodiment of the present invention.
Figure 3B:
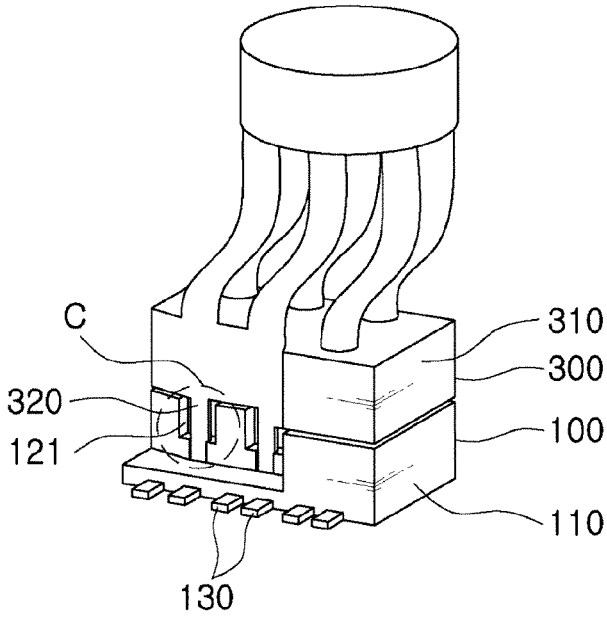

FIGS. 3A and 3B are configuration diagrams of a connector module according to another embodiment of the present invention.

The first connector 100 may be the same as the connector 100 shown in FIGS. 1A and 1B, and thus, detailed descriptions thereof will be omitted.

A second connector 300 may be electrically coupled with the first connector 100. To enable this, the second connector 300 may include a body 310 having a fixed volume, and a second pin unit 320 provided in the body 310 and electrically coupled with the second coupling unit 122 of the first connector 100. A plurality of second pins of the second pin unit 320 may correspond to the number of the coupling holes 120, and each of the plurality of second pins may be electrically coupled with the second coupling unit 122 as shown in FIG. 3B. Referring to reference numeral "C", when electrically coupled with the second coupling unit 122, the second pin does not contact the first coupling unit 121. In this case, a thickness of the second pin may be less than that of the first pin shown in FIGS. 3A and 3B.

Figure 4A:
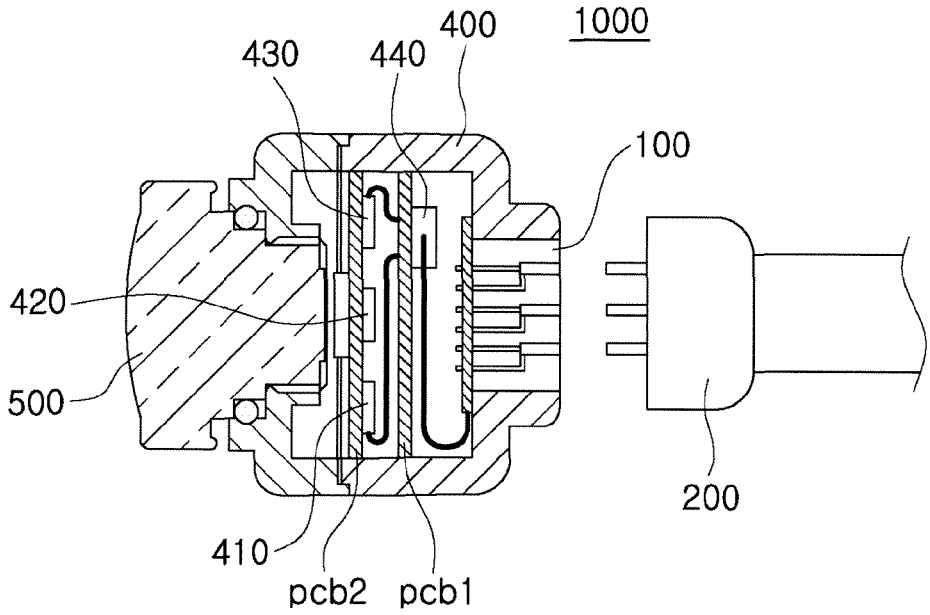
FIGS. 4A and 4B are configuration diagrams of an electronic apparatus according to an embodiment of the present invention.
Figure 4B:
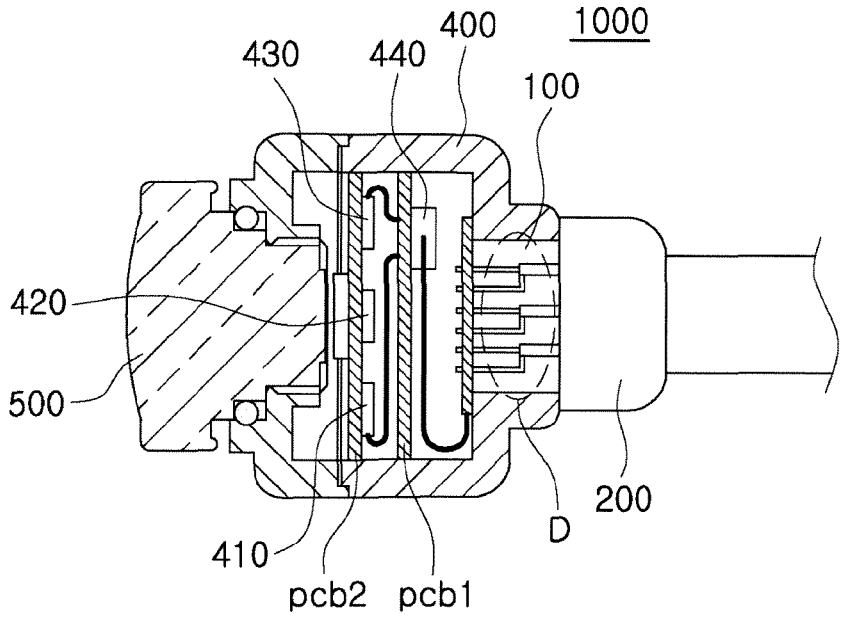
Figure 5A:
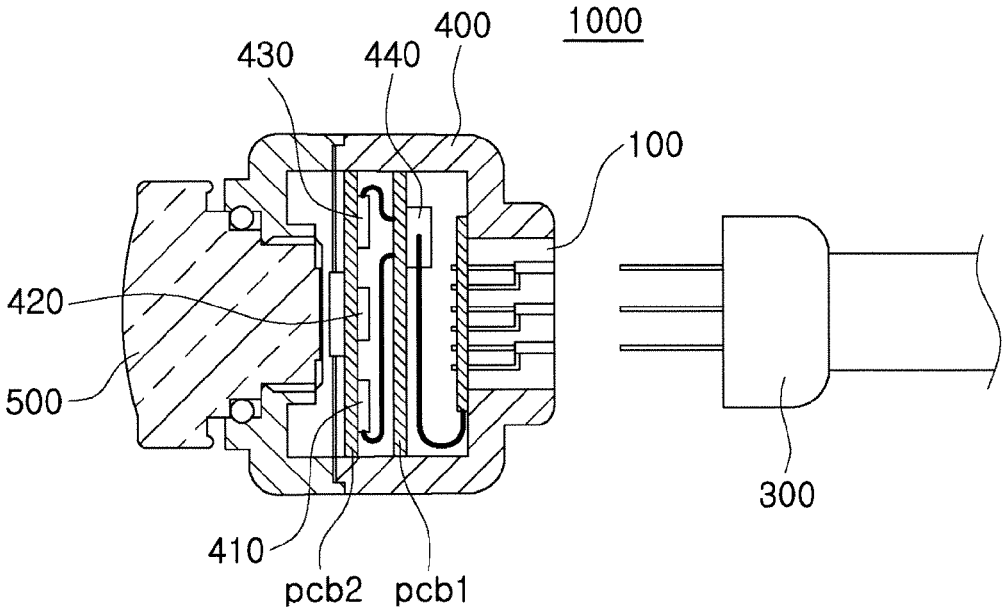
FIGS. 5A and 5B are configuration diagrams of an electronic apparatus according to another embodiment of the present invention.
Figure 5B:
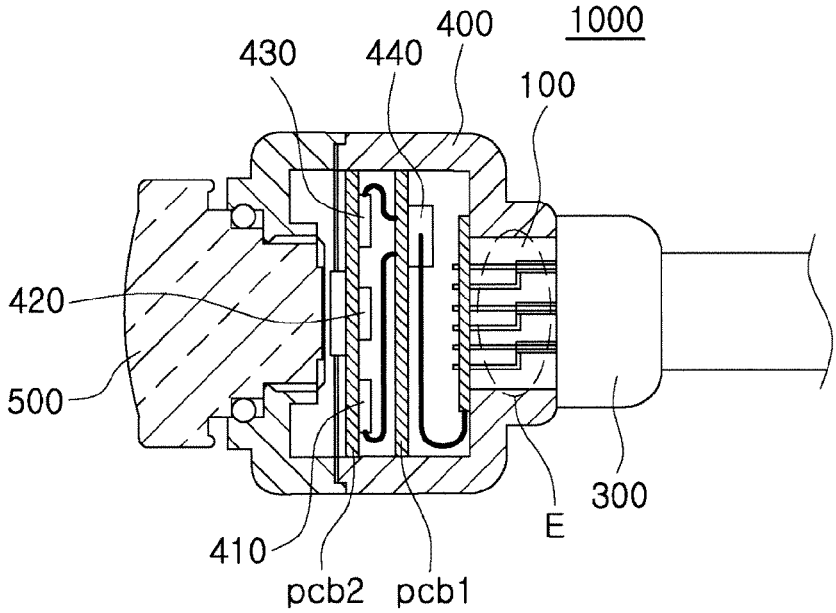

FIGS. 4A and 4B are configuration diagrams of an electronic apparatus according to an embodiment of the present invention, and FIGS. 5A and 5B are configuration diagrams of an electronic apparatus according to another embodiment of the present invention.

Referring to FIGS. 4A and 4B and FIGS. 5A and 5B, an electronic apparatus 1000 according to an embodiment of the present invention may include a first connector 100, a second connector 200 or 300, a housing 400, and an operation circuit 500.

The first connector may be the same as the connector 100 shown in FIGS. 1A and 1B, the second connector may be the same as the second connector 200 shown in FIGS. 2A and 2B or the second connector 300 shown in FIGS. 3A and 3B, and thus, detailed descriptions thereof will be omitted.

Figure 6:
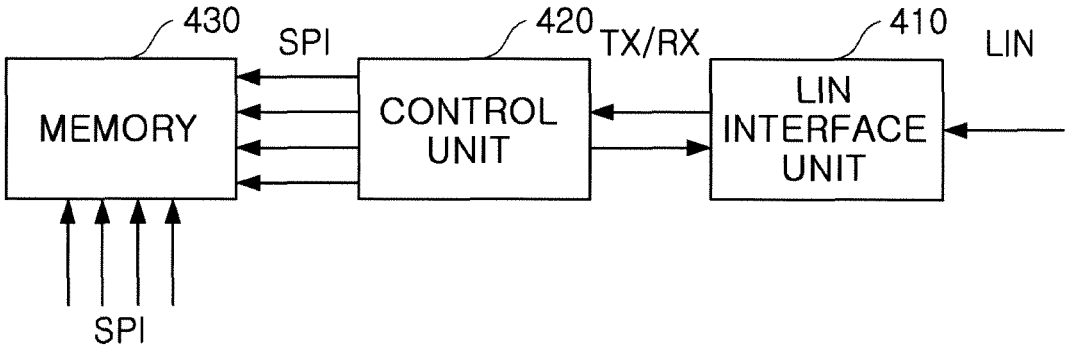
FIG. 6 is a configuration diagram of an electronic circuit applied to an electronic apparatus according to an embodiment of the present invention.

The housing 400 may support the first connector 100, and include an electronic circuit formed therein. As shown in FIG. 6, the electronic circuit may include a Local Interconnect Network (LIN) interface unit 410, a control unit 420, and a memory 430, and may further include a connection unit 440. The LIN interface unit 410 may be used in an interface scheme, mainly for displaying an image, and the control unit 420 may perform data communication with the outside through the LIN interface unit 410. The memory 430 may store data, and perform data communication with the control unit 420 in a Serial Peripheral Interface (SPI) scheme in response to a request of the control unit 420.

For example, an imaging apparatus may display an image, or upgrade or test an assembled product; however, it uses different interface schemes for these purposes. That is, the LIN interface scheme may be used to display the image, and the SPI scheme maybe used to upgrade or test product software. In this instance, a connector may be used for an electrical connection with the outside, and a terminal array is different for each interface scheme, such that a connector may be used for each of the interface schemes. Here, this may cause an increase in manufacturing costs and in a volume of a product. In the connector according to the embodiment of the present embodiment, a pin array may be commonly used for the interface schemes.

Figure 7A:
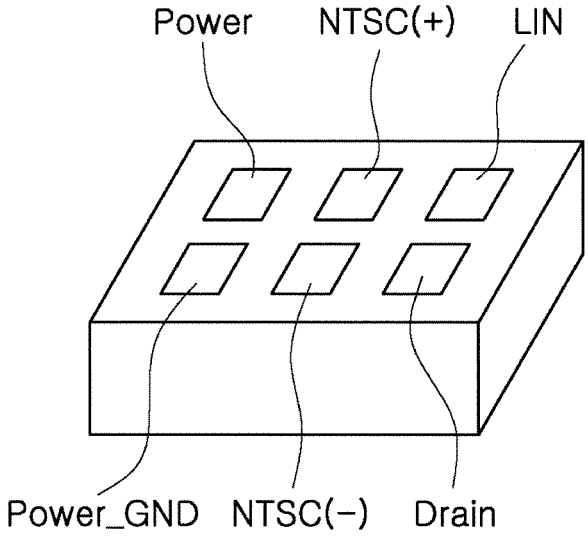
FIGS. 7A and 7B are configuration diagrams of a connector according to embodiments of the present invention.
Figure 7B:
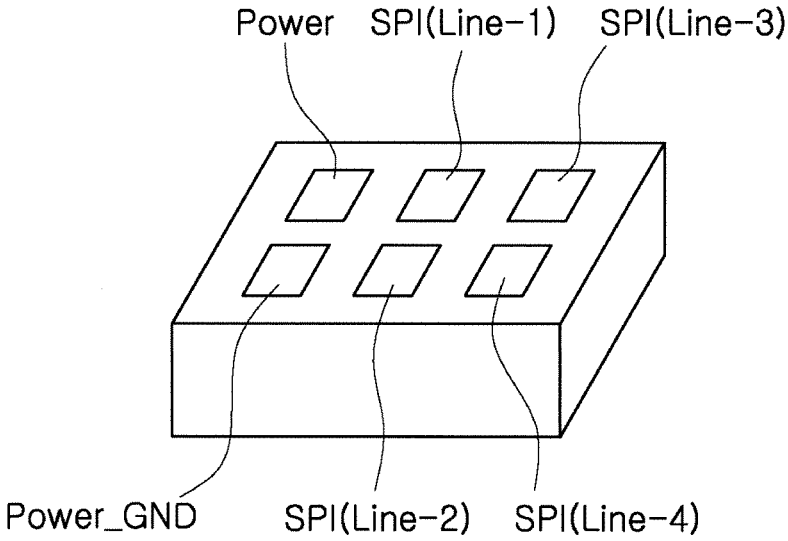

FIGS. 7A and 7B are configuration diagrams of a connector according to embodiments of the present invention.

For example, as shown in FIGS. 7A and 7B, when the connector according to the embodiment of the present invention is applied to the LIN interface scheme, a first coupling unit having six coupling holes may be respectively used as a power line (POWER, POWER_GND), an image line (NTSC (+), NTSC(−)), an LIN communication terminal (LIN), and an EMI shielding (Drain) terminal, and when the connector according to the embodiment of the present invention is commonly used for the SPI scheme, a second coupling unit having six coupling holes may be respectively used as a power line (POWER, POWER_GND), and first to fourth SPI lines (SPI (Line-1), SPI(Line-2), SPI(Line-3), and SPI(Line-4)).

Here, referring to FIGS. 4A and 4B and FIGS. 5A and 5B, the second connector may be coupled with the first coupling unit or the second coupling unit of the first connector 100 (reference numerals D and E) via the LIN interface scheme or the SPI scheme according to the interface scheme of the second connector 200 and 300. To enable this, the electronic circuit may further include the connection unit 440, and the connection unit 440 may connect a signal from the first coupling unit to the LIN interface unit 410, and connect a signal from the second coupling unit to the memory 430. In this case, the housing 400 may include a first printed circuit board (pcb1) and a second printed circuit board (pcb2). Here, the connection unit 440 may be formed in the first printed circuit board (pcb1), and the LIN interface unit 410, the control unit 420, and the memory 430 may be formed in the second printed circuit board (pcb2).

When the electronic apparatus 1000 is an electronic module used in vehicles and the like, particularly, an imaging apparatus, the operation circuit 500 may be a lens module, and a captured image may be stored in the memory 430 to be displayed to the outside through the LIN interface scheme. Also, software stored in the memory 430 may be directly connected to the outside through the SPI scheme to be subjected to upgrade or test at a high speed.

As set forth above, according to embodiments of the present invention, two coupling units having different depths may be formed in a single coupling hole to be commonly used for pins in different interface schemes without an increase in the number of the holes, thereby suppressing increases in manufacture costs and the volume of a product.

While the present invention has been shown and described in connection with the embodiments, it will be apparent to those skilled in the art that modifications and variations can be made without departing from the spirit and scope of the invention as defined by the appended claims.

What is claimed is:

1. A connector, comprising:

a body having a fixed volume; and at least one coupling hole formed inwardly in a side of the body, and electrically coupled with a pin from outside the body, wherein the coupling hole includes a first coupling unit having a predetermined first depth inward from the side of the body and electrically coupled with the pin from outside the body, and a second coupling unit having a second depth inward from the side of the body deeper than the first depth and electrically coupled with another pin from outside the body, wherein the second coupling unit extending from a bottom face of the first coupling unit.

2. The connector of claim 1, wherein the first coupling unit and the second coupling unit of the coupling hole have a step formed therebetween.

3. The connector of claim 2, wherein the first coupling unit has a lateral length and a longitudinal length of a cross section thereof larger than those of a cross section of the second coupling unit.

4. The connector of claim 1, wherein the coupling hole comprises a plurality of coupling holes formed in the side of the body.

5. A connector module, comprising:

a first connector including a first body having a fixed volume, and at least one coupling hole formed inwardly in a side of the first body and electrically coupled with a pin from outside the first body, the coupling hole including a first coupling unit having a predetermined first depth inward from the side of the body and electrically coupled with the pin from outside the first body, and a second coupling unit having a second depth inward from the side of the body deeper than the first depth and electrically coupled with another pin from outside the first body; and a second connector including a second body having a fixed volume, and a pin formed on a side of the second body and inserted into the coupling hole, wherein the second coupling unit extending from a bottom face of the first coupling unit.

6. The connector module of claim 5, wherein the second connector includes a plurality of pins.

7. The connector module of claim 5, wherein the second connector includes a first pin unit having a first pin electrically coupled with the first coupling unit, or a second pin unit having a second pin electrically coupled with the second coupling unit.

8. The connector module of claim 5, wherein the first coupling unit and the second coupling unit of the coupling hole have a step formed therebetween.

9. The connector module of claim 8, wherein the first coupling unit has a lateral length and a longitudinal length of a cross section thereof larger than those of a cross section of the second coupling unit.

10. The connector module of claim 6, wherein the coupling hole comprises a plurality of coupling holes formed in the side of the first body.

11. An electronic apparatus, comprising:

a connector module including a first connector including a first body having a fixed volume, and at least one coupling hole formed inwardly in a side of the first body and electrically coupled with a pin from outside the first body, the coupling hole including a first coupling unit having a predetermined first depth inward from the side of the body and electrically coupled with the pin from outside the first body and a second coupling unit having a second depth inward from the side of the body deeper than the first depth and electrically coupled with another pin from outside the first body, and a second connector including a second body having a fixed volume, and a pin formed on a side of the second body and inserted into the coupling hole;

a housing supporting the first connector and having an electronic circuit electrically connected with the coupling hole; and an operation circuit supported by the housing, and connected to the electronic circuit to execute a predetermined operation, wherein the second coupling unit extending from a bottom face of the first coupling unit.

12. The electronic apparatus of claim 11, wherein the first coupling unit and the second coupling unit of the coupling hole have a step formed therebetween.

13. The electronic apparatus of claim 12, wherein the first coupling unit has a lateral length and a longitudinal length of a cross section thereof larger than those of a cross section of the second coupling unit.

14. The electronic apparatus of claim 11, wherein the coupling hole comprises a plurality of coupling holes formed in the side of the body.

15. The electronic apparatus of claim 14, wherein the second connector includes a plurality of pins.

16. The electronic apparatus of claim 11, wherein the second connector includes a first pin unit having a first pin electrically coupled with the first coupling unit, or a second pin unit having a second pin electrically coupled with the second coupling unit.

17. The electronic apparatus of claim 11, wherein the electronic circuit includes:

a Local Interconnect Network (LIN) interface unit electrically connected with the first coupling unit to perform data communication in an LIN interface scheme;

a control unit performing data communication with the LIN interface unit to control memory storage; and a memory electrically connected with the control unit and the second coupling unit to perform data communication in a Serial Peripheral Interface (SPI) scheme.

18. The electronic apparatus of claim 11, wherein the operation circuit is a lens module imaging an object.

19. The electronic apparatus of claim 17, wherein the electronic circuit further includes a connection unit electrically connecting the first coupling unit with the LIN interface unit, and electrically connecting the second coupling unit with the memory.

20. The electronic apparatus of claim 19, wherein the housing further includes a first circuit board and a second circuit board, the connection unit is formed in the first circuit board, and the LIN interface unit, the control unit, and the memory are formed in the second circuit board.

* * * * *

UNITED STATES PATENT AND TRADEMARK OFFICE

CERTIFICATE OF CORRECTION

PATENT NO. : 8,636,547 B2
APPLICATION NO. : 13/327259
DATED : January 28, 2014
INVENTOR(S) : Joo Young Ha et al.

It is certified that error appears in the above-identified patent and that said Letters Patent is hereby corrected as shown below:

On the Title Page, Item (54), and in the Specification, Column 1, Lines 1-3, Title:

"CONNECTOR WITH A SECOND COULING UNIT EXTENDING FROM A BOTTOM FACE OF A FIRST COUPLING UNIT" should read "CONNECTOR WITH A SECOND COUPLING UNIT EXTENDING FROM A BOTTOM FACE OF A FIRST COUPLING UNIT"

Signed and Sealed this
Tenth Day of June, 2014

Michelle K. Lee

Michelle K. Lee
*Deputy Director of the United States Patent and Trademark Office*